United States Patent [19]

Thomson

[11] 4,079,684

[45] Mar. 21, 1978

[54] SEWING MACHINE

[75] Inventor: James E. Thomson, Pleasant Lake, Mich.

[73] Assignee: Western Stamping Corporation, Jackson, Mich.

[21] Appl. No.: 741,765

[22] Filed: Nov. 15, 1976

Related U.S. Application Data

[63] Continuation-in-part of Ser. No. 589,552, Jun. 23, 1975, abandoned.

[51] Int. Cl.[2] ..... D05B 1/06

[52] U.S. Cl. ..... 112/199; 112/169; 112/215; 112/258; 85/37; 85/DIG. 2

[58] Field of Search ..... 112/198, 199, 258, 259, 112/260, 215, 221, 203, 169; 74/45; 85/37, 38, DIG. 2; 151/38

[56] References Cited

U.S. PATENT DOCUMENTS

| | | | |
|---|---|---|---|
| 1,875,930 | 9/1932 | Martin | 151/38 |
| 2,517,476 | 8/1950 | Frost | 151/38 |
| 2,750,907 | 6/1956 | Langhein | 112/259 X |
| 2,912,734 | 11/1959 | Becker | 85/37 X |
| 3,168,849 | 2/1965 | Zilg et al. | 112/258 X |
| 3,469,490 | 9/1969 | Pearce, Jr. | 85/37 X |

*Primary Examiner*—Werner H. Schroeder

*Assistant Examiner*—Moshe I. Cohen

*Attorney, Agent, or Firm*—Harness, Dickey & Pierce

[57] ABSTRACT

A chain stitch sewing machine is operated by two substantially parallel and horizontal levers, one of which is medially pivoted in the head and the other in the base. The levers are connected together by a link and actuated by a crank directly connected to the upper lever. The upper lever, which is slidable along its fulcrum to accommodate the throw of the crank, actuates the needle bar. The lower lever actuates a swingable hook by means of a cam secured to the hook and pivoted therewith in the base. A feed dog supported for vertical and horizontal movement in the base has a camming portion interposed between the cam and hook and which is also actuatable by the lower lever and by the cam.

In a modification, the upper lever, which is of the first class, does not slide along its fulcrum axis. The actuating arm of the lever is laterally flexible, in a direction parallel to the fulcrum axis, but rigid in a plane perpendicular to such axis, and at its free end is directly pivoted to the crank.

A thread tensioner has smooth plastic surfaces between which the thread is passed and which can be urged together with variable tension by a cam acting through a spring.

20 Claims, 36 Drawing Figures

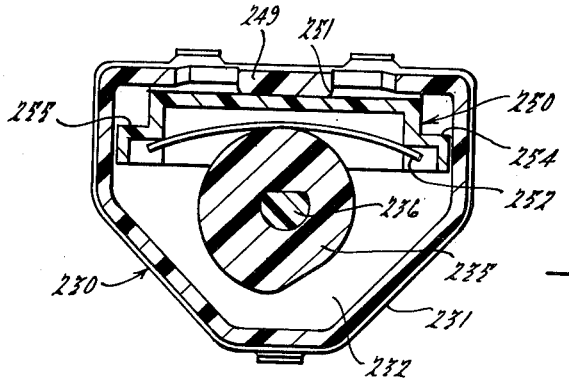
FIG. 20.
FIG. 16.
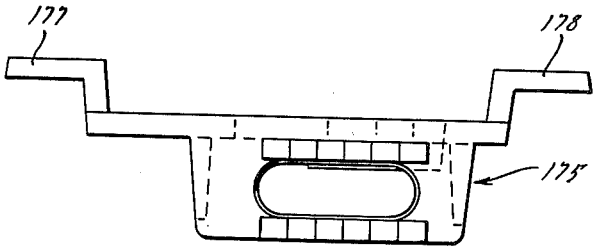
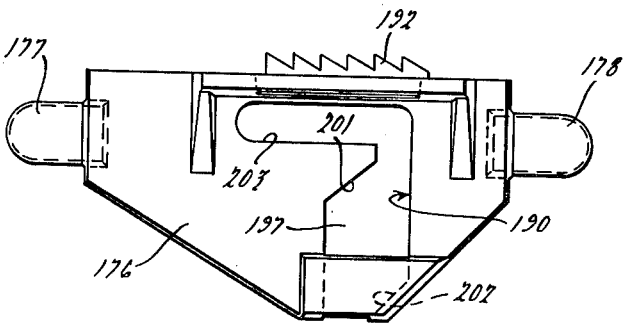
FIG. 17.
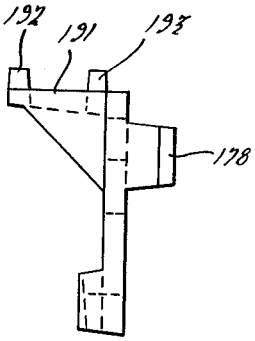
FIG. 18.
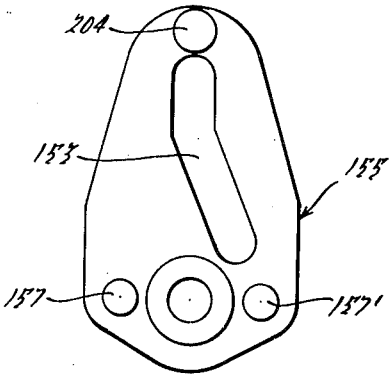
FIG. 19.
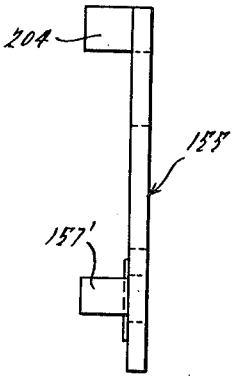
FIG. 20.
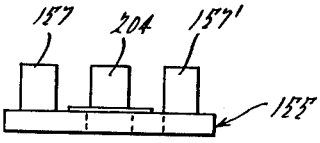
FIG. 21.

Fig. 33.
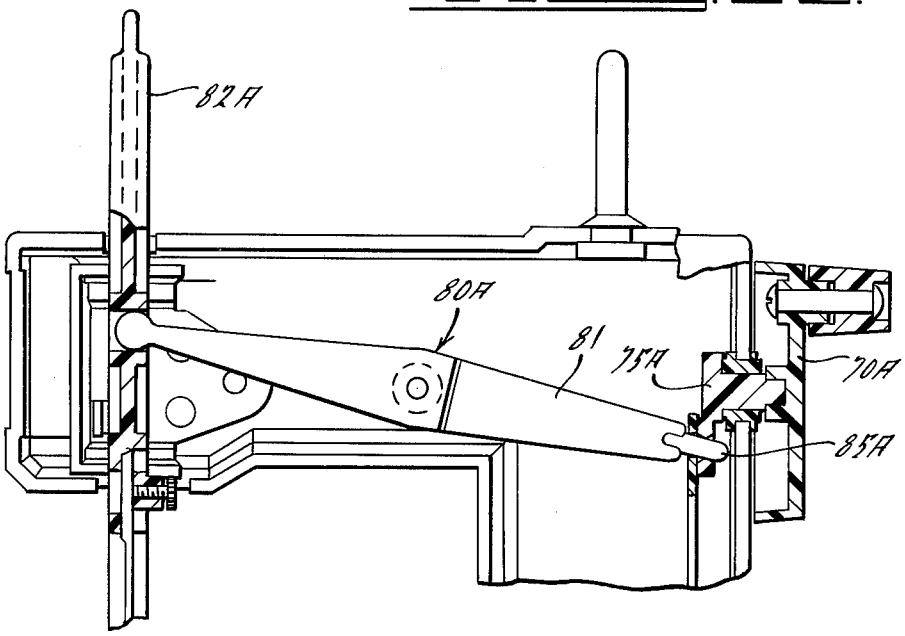
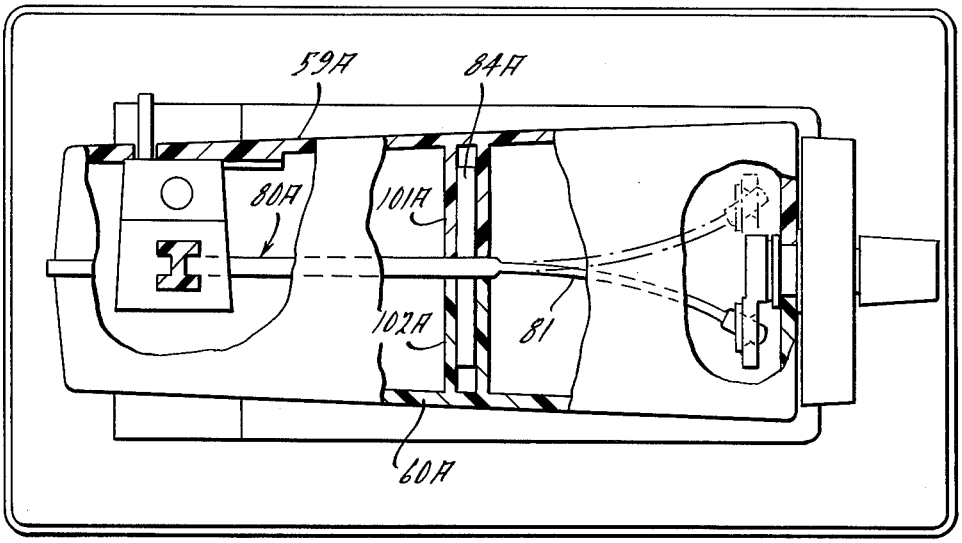
Fig. 34.

SEWING MACHINE

REFERENCE TO RELATED APPLICATION

The present application is a continuation-in-part of previously filed, copending application Ser. No. 589,552, filed June 23, 1975, entitled "Sewing Machine", now abandoned.

BACKGROUND OF THE INVENTION

Toy sewing machines of good quality possess desirable educational as well as entertainment value, but have become relatively expensive due to the precision required in the construction and assembly of working parts. With constructions currently known it is normally necessary, in order to satisfactorily complete the manufacturing process and obtain a reliable sewing action, to individually manually adjust several of the working parts of each machine. Such adjustments of course add substantially to the cost of the machine.

The overall object of the present invention is to provide an improved, highly reliable chain-stitch sewing machine which can be sold as a toy at a substantially lower cost than known machines which are capable of comparable performance. A related object is to provide such a machine having working parts of accurately molded and fitted plastic and which when assembled are inherently so accurately related to each other that special individual adjustments of working parts after assembly are not required.

Another object is to provide such a machine having a unique and simplified but highly accurate and reliable mechanism for the needle bar, sewing hook and feed dog.

Another object is to provide an improved inexpensive, accurate and reliable adjustable thread tensioning device.

Other objects and advantages will become apparent upon consideration of the present disclosure in its entirety.

BRIEF DESCRIPTION OF THE FIGURES OF DRAWING

FIG. 16 is an enlarged top plan view of the feed dog;

FIG. 17 is a left side elevational view of the same;

FIG. 18 is a front end view of the same;

FIG. 19 is an enlarged left side elevational view of the actuating cam;

FIG. 20 is a front end view of the same;

FIG. 21 is a top plan view of the same;

FIG. 29 is a sectional elevational view taken substantially on the line XXIX—XXIX of FIG. 27 and looking in the direction of the arrows;

FIG. 33 is a view corresponding to the upper portion of FIG. 2 but showing a modified construction;

FIG. 34 is a top plan view of the modified construction with parts broken away;

DETAILED DESCRIPTION OF THE PREFERRED FORMS OF THE INVENTION

Figure 1:
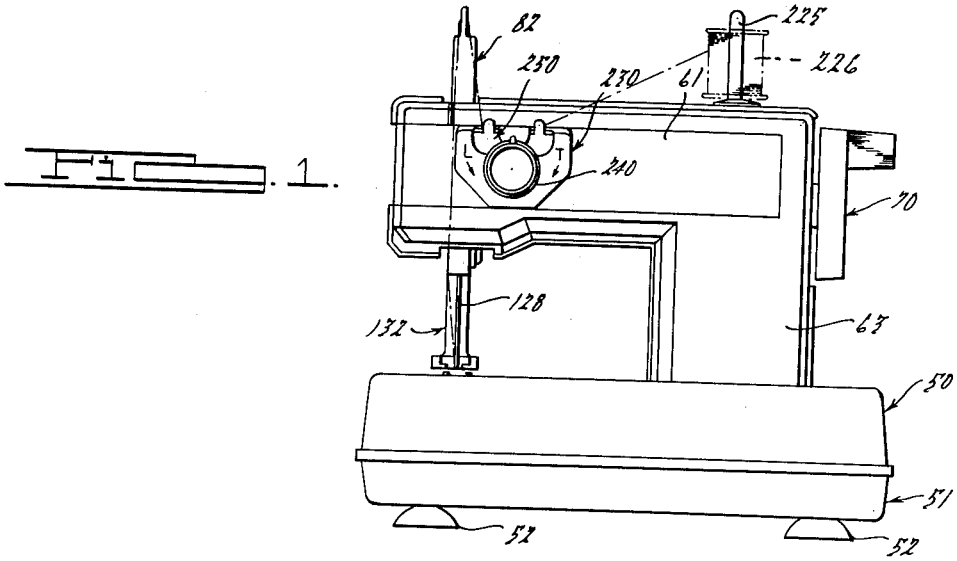
FIG. 1 is a front elevational view of a toy sewing machine incorporating the principles of the present invention.

The base of the machine is formed of upper and lower parts generally designated 50, 51, respectively, molded of a suitable plastic such as polystyrene, and which cooperate to define a box-like chamber 53. The bottom base part 51 comprises a tray-like molding equipped with suction cup-type feet 52. The inverted upper base portion 50 has a large rectangular central opening 54 for a flat bed portion 55 which is molded as an integral part of a polystyrene main frame structure generally designated 56. Bed portion 55 is flush with the top of upper base portion 50 and cooperates therewith to define the sewing table.

The main frame structure includes an upper rear housing comprising a column part 65 upstanding from the right end of bed portion 55 near the rear, and a horizontal top head portion 57 extending to the left from the column portion. The head and column portions are hollow and open toward the front, defining the rear half of an upper housing structure of generally conventional shape having a flat rear wall 59.

A front housing portion 60 is formed as a separate part, having conforming rearwardly facing concave head and column portions 61, 63, respectively. The front and rear housing portions are secured together in accurate alignment by overlapping alignment lug portions 62 and screws as 64 extending through interfitted pilot bosses 76, 77. The column chamber 68 communicates interiorly with the head chamber 66. (The machine is of course designed to be cranked from the right end, and the rear of the machine is considered as away from the user; directional references herein are on such basis.)

Figure 3:
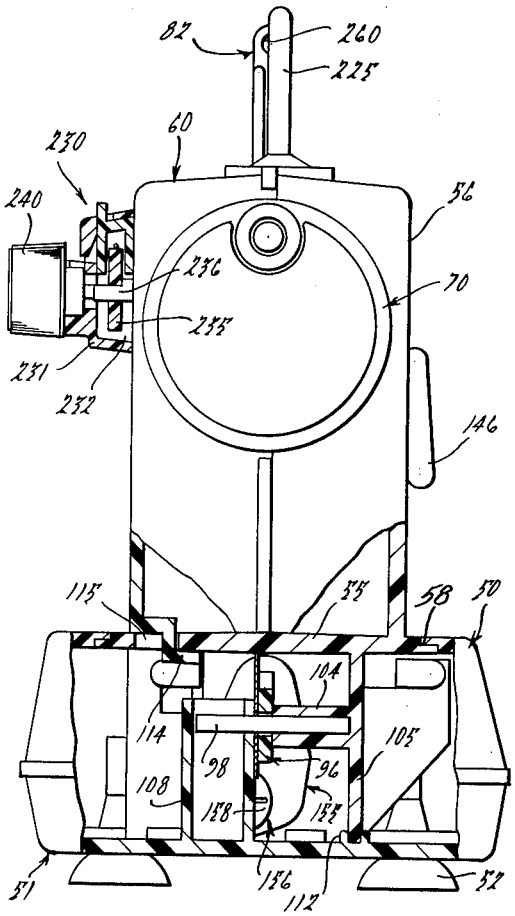
FIG. 3 is a right end elevational view with parts broken away and in section.

As best shown in FIG. 3, the front upper housing portion 60 is further located with respect to portion 56 by an integral tongue portion 114 of stepped form which is projected through an opening 115 in bed portion 55 to underlie the latter while concealing the opening 115.

Also integral with main frame structure 56 are a flat longitudinal back wall 105 extending downwardly from bed portion 55 and laterally spaced end wall portions 110, 111, joined to and extending forwardly from back wall 105. Walls 105, 111 extend downwardly all the way to the flat bottom wall 114 of lower base portion 51 and project into locating slots formed by integral ribs as 112 formed on the upper surface of the bottom wall of base portion 51. The upper base portion 50 overlaps a rim flange 58 on bed portion 55 and the base sections are secured together by screws 69 extending through and threaded into interfitted pilot bosses 71, 73.

The vertical right-end wall 67 formed by the column and head portions is flat, and carries a wheel-shaped hand crank, generally designated 70, secured to the projecting extremity of a shaft portion 72 journaled in a bearing bushing 74 held in an opening formed by semicircular cutouts (undesignated) in the mating edges of such wall portions of the two upper head sections. Shaft portion 72 is integral with a drive crank 75 inside the head and has been molded of polystyrene. Other working parts such as the needle bar, presser foot, levers, sewing book (to be described), bearing bushing 74, etc., may be molded of a strong, wear-resistant plastic such as an acetal resin of the character sold by E. I. Du Pont de Nemours & Co. under the trademark "Delrin".

An operating lever 80 for the needle bar 82 is medially journaled on a horizontal fore and aft axis on a fulcrum pin 84 in the head chamber 66. A longitudinal cylindrical end portion 85 of the lever 80 projects into an opening (undesignated) in the crank 75. The other arm of lever 80 has an end 86 rounded on an axis parallel to the fulcrum and which extends into an opening 87 in the needle bar 82 to actuate the latter.

Figure 5:
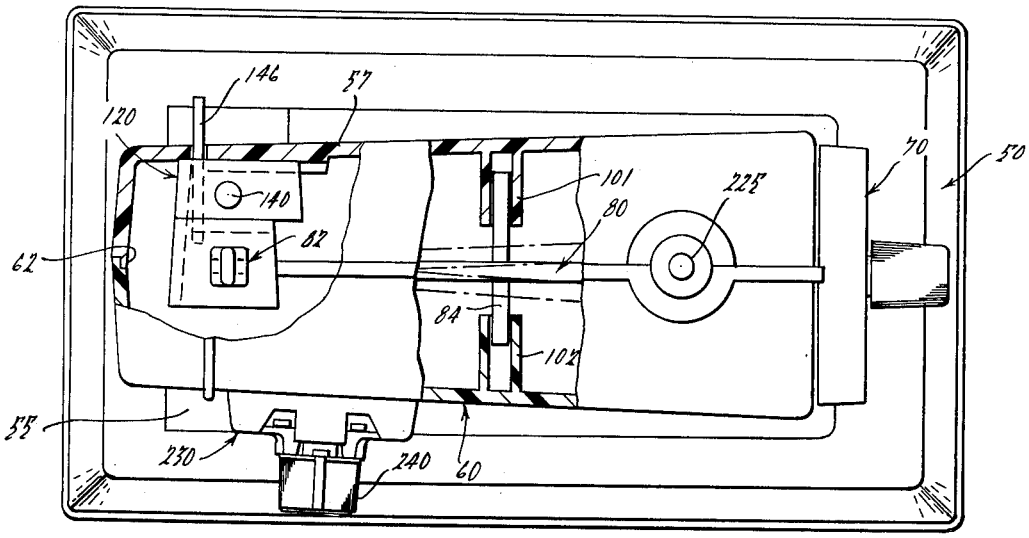
FIG. 5 is a top plan view with parts broken away and in section.

A flat plastic link 90 journaled on the portion 85 of the lever 80 extends downwardly to and at its lower end is journaled on the cylindrical right end portion 95 of a second lever 96 arranged generally parallel to the upper lever 80 and fulcrumed in the base chamber 53 on a pin 98. The fulcrum pin 84 for the upper lever is supported in bosses 101, 102 which respectively project forwardly and rearwardly from and are integral with the rear and front housing portions 57, 60. The free ends of the bosses 101, 102 are substantially spaced from one another, as best shown in FIG. 5, so that the lever may slide along the pin 84 and rock in a forward and rearward direction about a vertical axis in the needle bar as the crank is turned, to allow for the throw of the crank 75 without resultant binding. The opening 87 in the needle bar 82 is wide enough in a fore and aft direction to permit such movement of the lever.

The fulcrum pin 98 for the bottom lever 96 is supported by and trapped between a boss 104 projecting forwardly from wall 105 and a rigid cylindrical upstanding notched boss 108 integral with base portion 51.

Figure 2:
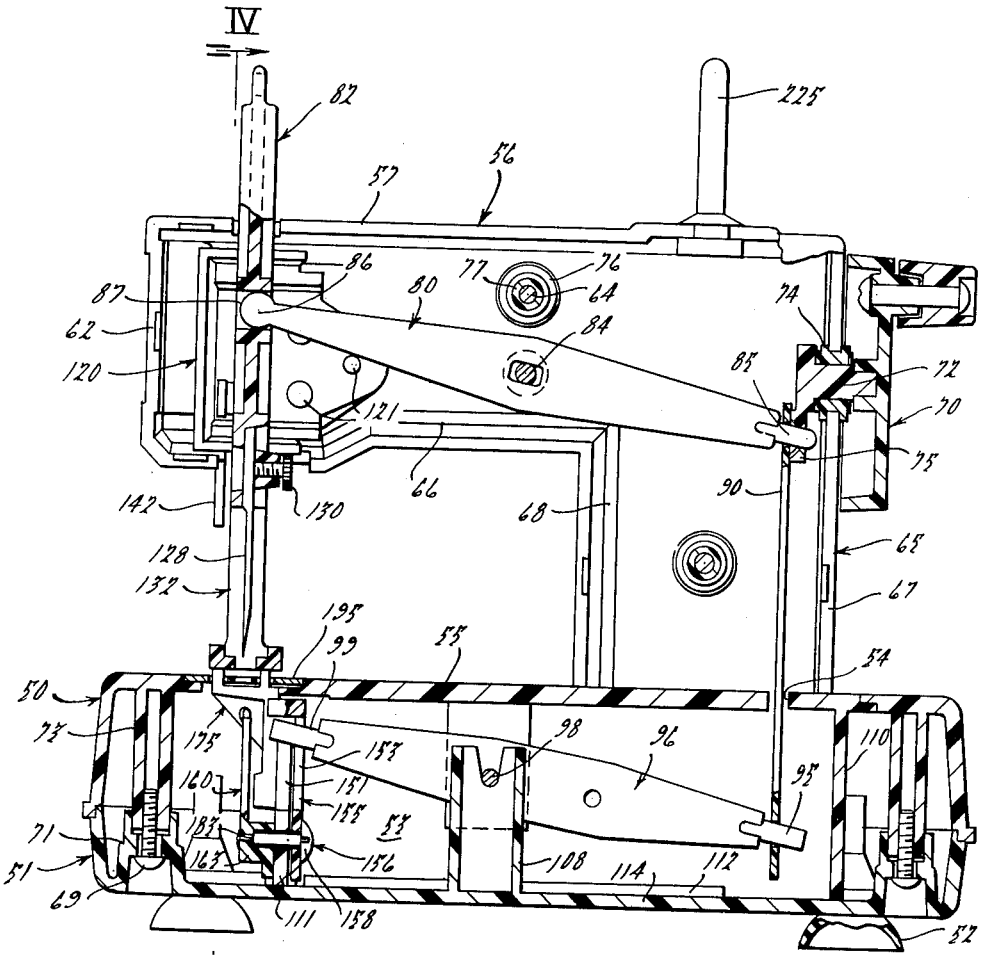
FIG. 2 is a substantially central longitudinal vertical sectional elevational view thereof.
Figure 9:
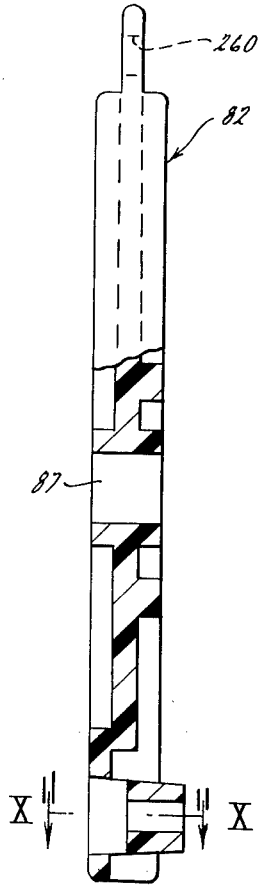
FIG. 9 is an enlarged view of the needle bar, partly in section and partly in side elevation.
Figure 6:
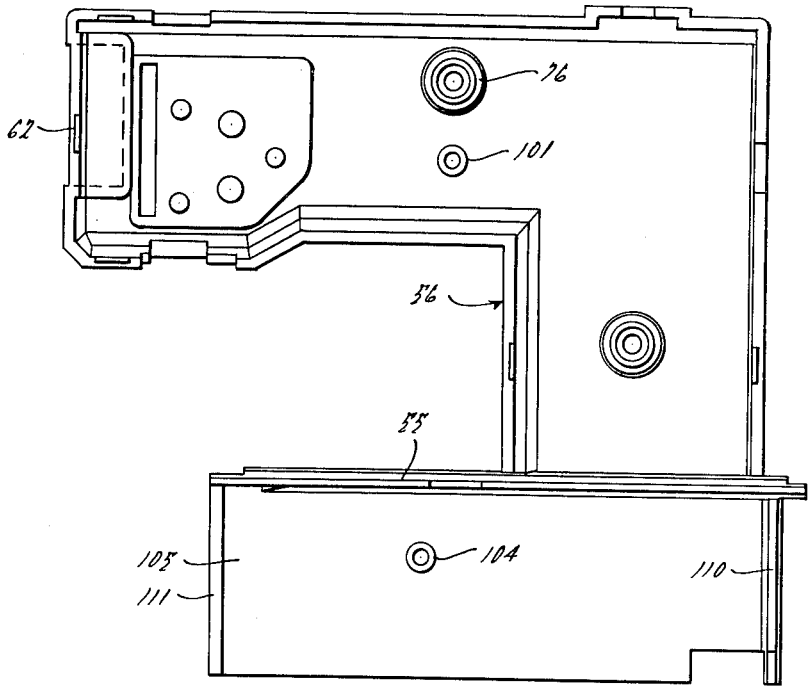
FIG. 6 is a front elevational view of the main frame structure.
Figure 7:
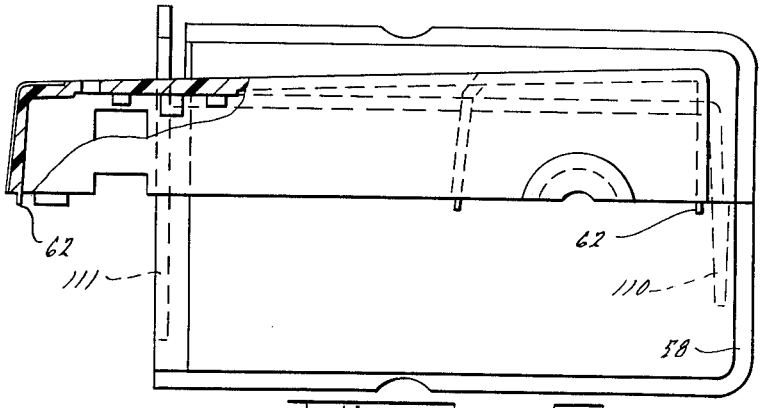
FIG. 7 is a top plan view of the same, with a portion broken away and shown in section.
Figure 10:
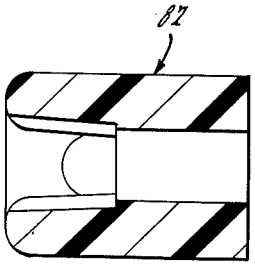
FIG. 10 is a further enlarged sectional detail taken substantially on the line X—X of FIG. 9 and looking in the direction of the arrows.
Figure 8:
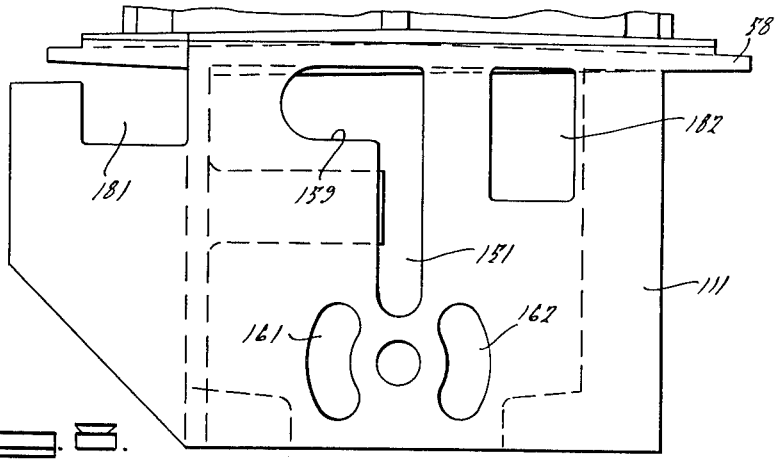
FIG. 8 is a left end elevational view of the same with the upper portion broken away.
Figure 15:
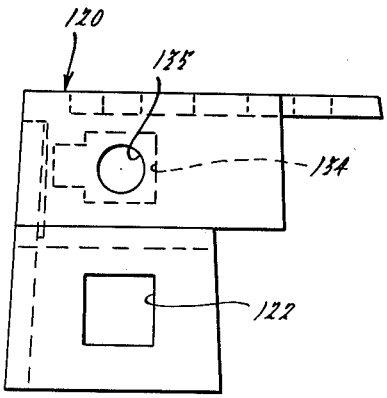
FIG. 15 is a top plan view of the needle bar and presser foot guide.
Figure 14:
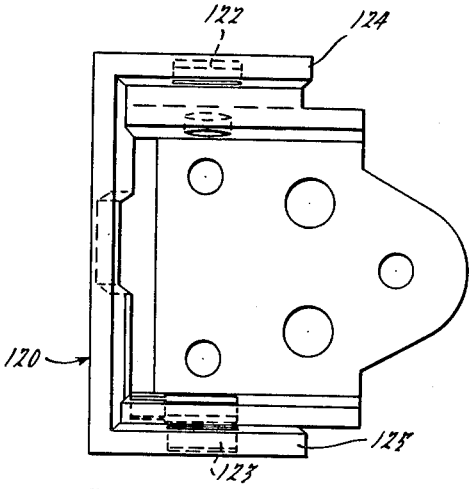
FIG. 14 is a front elevational view of the needle bar and presser foot guide, also on an enlarged scale.
Figure 11:
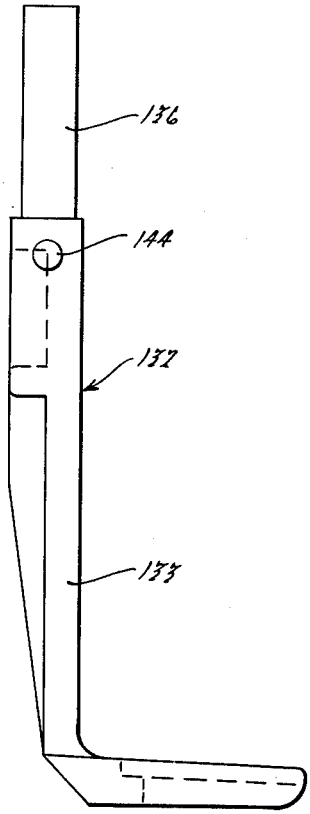
FIG. 11 is an enlarged side elevational view of the presser foot.
Figure 12:
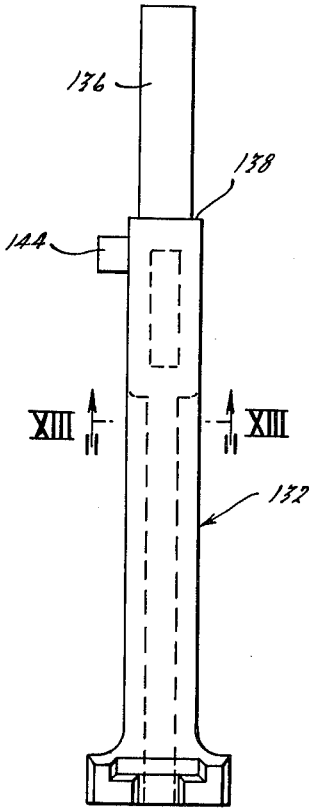
FIG. 12 is a front elevational view of the presser foot.
Figure 13:
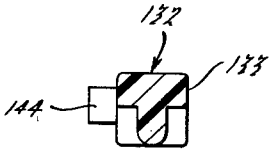
FIG. 13 is a sectional detail taken substantially on the line XIII—XIII of FIG. 12 and looking in the direction of the arrows.
Figure 24:
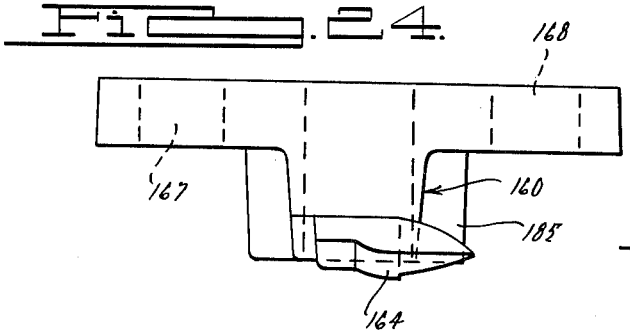
FIG. 24 is a top plan view of the same.
Figure 35:
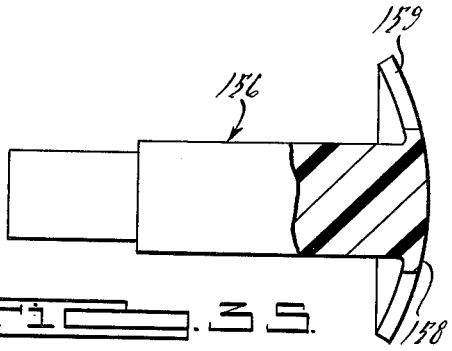
FIG. 35 is a diametric longitudinal section of a combined rivet and spring member.
Figure 36:
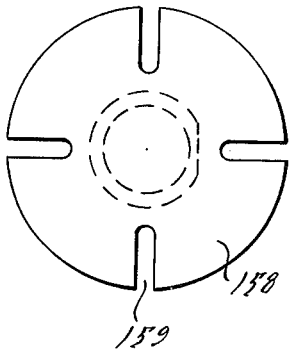
FIG. 36 is an end elevation as from the right of FIG. 35.
Figure 22:
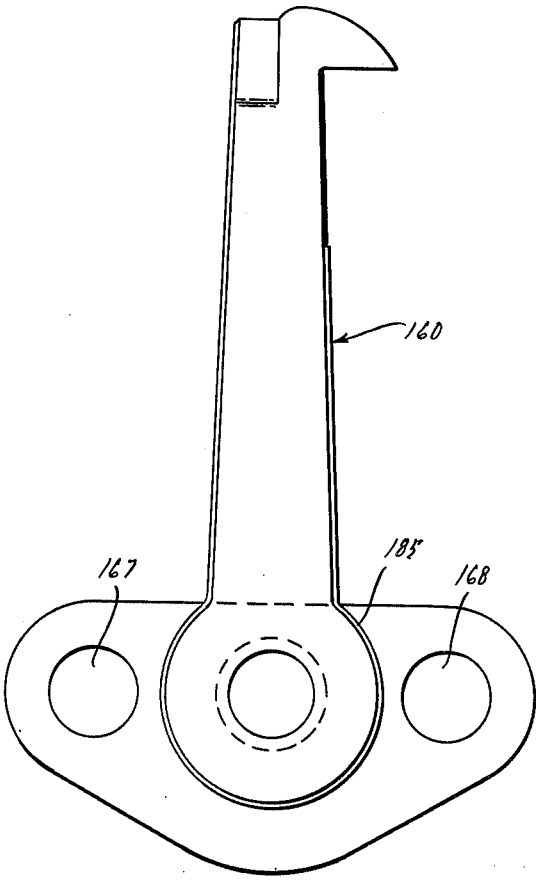
FIG. 22 is a greatly enlarged left side elevational view of the sewing hook.
Figure 23:
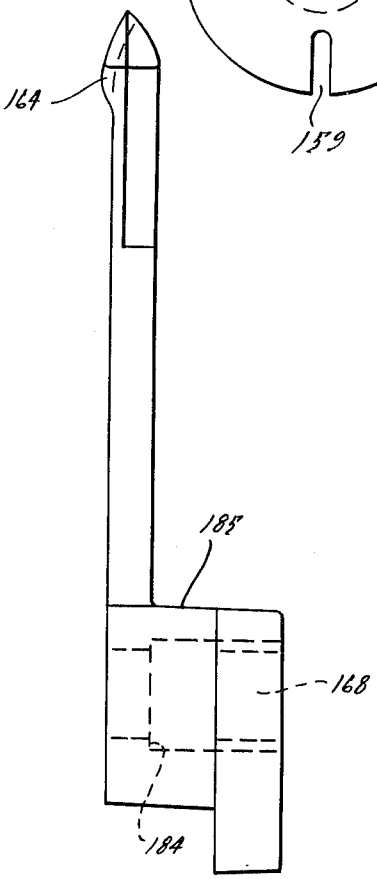
FIG. 23 is a front elevational view thereof.
Figure 25:
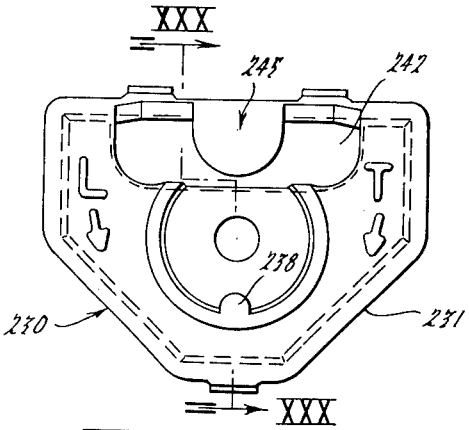
FIG. 25 is an enlarged front elevational view of the thread tensioner housing.
Figure 30:
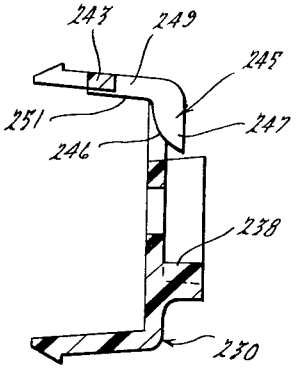
FIG. 30 is a sectional elevational view of the thread tensioner housing, taken substantially as indicated by the line and arrows XXX—XXX of FIG. 25 and looking in the direction of the arrows.
Figure 26:
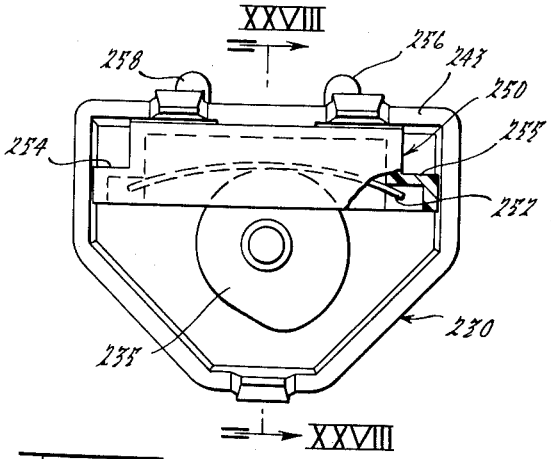
FIG. 26 is a rear elevational view of the thread tensioner.

The configuration of the needle bar is best shown in FIGS. 2, 9 and 10. It is of substantially rectangular cross section, and journaled for vertical reciprocation in a guide member generally designated 120 located in head chamber 66 and secured to the back wall 59 by integral rivetable stud portions 121. The construction of the guide is shown in FIGS. 14 and 15. The needle bar is accurately fitted in square bearing openings as 122, 123 formed in the top and bottom vertically-spaced, substantially parallel and horizontal walls 124, 125, respectively, of the guide member 120. A conventional sewing machine needle as 128 is adapted to be secured in the needle bar by means of a thumb screw 130, as shown in FIG. 2.

The presser foot generally designated 132 has an integral vertical shaft portion which is also guided in the top and bottom walls 124, 125 of the guide member 120. The lower part 133 of the shaft portion of the presser foot is of rectangular cross section and is slidably fitted in a generally rectangular bearing opening 134 in lower wall 125 of guide 120, while the upper part 136 of the presser foot shaft portion, which is guided in the upper wall 124, is of circular cross section and is guided in a circular guide hole 135. The juncture between the cylindrical upper portion 136 and the rectangular lower portion 133 defines a shoulder 138 which furnishes an abutment for the helical compression presser foot spring 140, which is trapped between the shoulder 138 and the underside of top wall 124 of the guide 120. A presser foot lifting member 142, in the shape of a bellcrank, is journaled on an integral bearing lug 144 projecting from the side of the presser foot at a position between the walls 124, 125. One arm 146 of the lifter 142 projects rearwardly and downwardly from the head where it is accessible to permit the same to be moved up and down. When the arm 146 is raised, a rounded cam portion 148 on the extremity of the pivoted arm 147 bears downwardly against the upper surface of the bottom wall 125 of the guide to lift the presser foot clear of the work, while when arm 146 is lowered the presser foot is free to descend into engagement with the work under the influence of the spring, the parts then being in the position shown in FIG. 4. The openings (undesignated) in the head portions through which the needlebar and presser foot extend provide clearance for these parts, which are guided entirely by the guide member 120.

At its left end the bottom lever 96 carries an integral longitudinal cylindrical extension portion 99 which during oscillation of the lever travels in a vertical slot portion 151 in the wall 111. The portion 99 also projects through an angular slot 153 in a timing cam 155 to actuate the latter. Cam 155 is pivoted near its lower extremity on the right-hand side of the wall 111 by means of a "Delrin" combined rivet and spring 156 which is journaled in the wall 111 and extends through and beyond the same to the left, supporting on the left side of the wall 111 the sewing hook generally designated 160. The timing cam 155 and sewing hook 160 are also formed of a molded plastic such as "Delrin". The timing cam has a pair of lugs 157, 157', projecting from its left side through the wall and accurately slidably interfitted with openings 167, 168 in the sewing hook. The lugs are swingable in arcuate clearance slots 161, 162 in the wall 111 and accurately fit in the holes 167, 168 in the hook, so that the hook is rocked toward the front and rear by the cam in response to reciprocation of the lever 96. The hub portion 163 of the hook spaces it to the left of the wall 111 and in a position such that the hook and needle pass in close wiping engagement to each other.

A feed dog generally designated 175 has an integral cam portion 176 of generally flat form which depends into the space between the hook and the wall 111, lying parallel to the latter, and is actuatable by the cam 155 and lever portion 99. The feed dog is guided for vertical and horizontal movement in the wall 111 by means of integral tongues 177, 178 which project through openings 181, 182 in the wall 111 and lie closely against the right side of the wall. It will be noted that the rivet 156 has a shoulder 183 which seats against an internal shoulder 184 in the apertured hub 185 of the hook 160. The shoulders 183, 184 are so positioned that when the rivet is upset on the left side of the hook 160, the cam 155 and hook 160 are held in accurately spaced relation against the opposite walls of the wall 111, leaving space for free movement of the feed dog, but are freely rotatable as a unit. The hook 160 and cam 155 are slidable on the smooth shank of the rivet, and the head 158 of the rivet is cupped and radially slotted as shown at 159, and is somewhat flattened and stressed when the left end of the stem is upste, so that the head acts as a Belleville washer-type spring yieldably urging the hook 160 and cam 155 against opposite sides of the wall 111, which thus locates these parts accurately with relation to the needle bar, which is in turn accurately positioned with relation to the hook by reason of the unitary construction of the main frame structure 56 and the integral pilot and securing rivetable studs 121 which locate the guide 120.

As best shown in FIG. 2, the actuating end portion 99 of bottom lever 96 also projects through and beyond the slot 151 in the wall 111 and into a cutout cam opening generally designated 190 in the flat cam section 176 of the feed dog, which is guided on the wall 111 as previously described. A transverse top portion 191 of the feed dog has conventional work-feeding teeth arranged in two laterally spaced parallel series 192, 193 and which extend upwardly in the conventional manner through slots (undesignated) in a needle plate 195. The cam opening 190 has a relatively wide vertical portion 197 having upper and lower inclined camming surfaces 201, 202. Engagement of the actuating portion 99 with cam surface 201 is effective to move the feed dog rearwardly, to advance the work, while when portion 99 moves down to and along cam surface 202, it is effective to retract the feed dog. A lug portion 204 of cylindrical form and which is integral with the cam 155 extends to the left from the upper end of the cam into a continuation slot portion 203 extending horizontally rearwardly from the top of the cam opening 190. A corresponding clearance portion 159 forming a lateral extension of the slot 151 in the wall 111 permits free movement of the lug 204 in the horizontal slot portion 203. It will be noted that the rectangular opening 182 in the wall 111 is substantially longer in its vertical dimension than the tongue 178, while the opening 181 for the tongue 177 has its bottom wall at a higher position.

Figure 4:
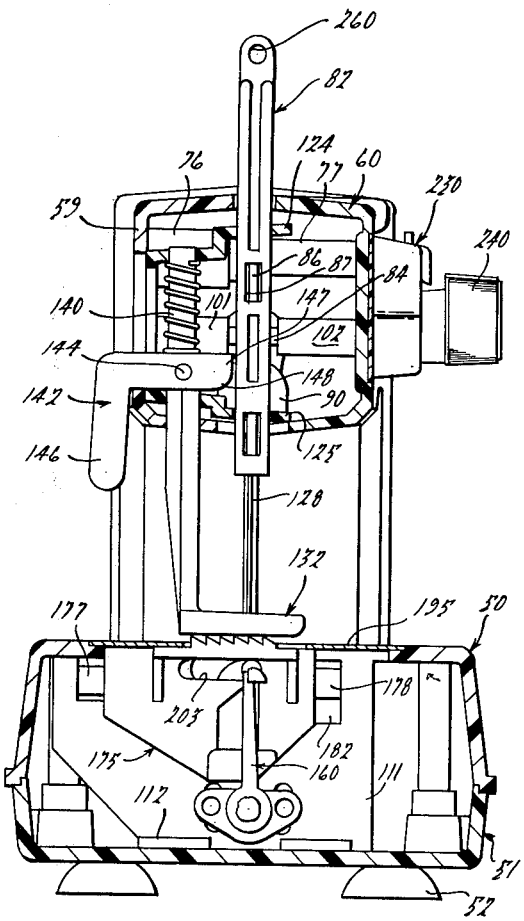
FIG. 4 is a vertical cross section taken substantially on the line IV—IV of FIG. 2 and looking in the direction of the arrows.

The machine operates as a conventional chain-stitch machine of the swinging hook type insofar as the sewing action is concerned. The needle carries the thread through the work as the hook moves back, and the hook moves forward through the loop which is formed as the needle retracts, whereafter the needle descends alongside the hook which remains in the forward position until the needle has passed through the thread on the hook and pulls back up through the material, which is advanced, as the needle reaches a raised portion free of the work, by the feed dog, which is moved in the feed direction, toward the rear of the machine, by the engagement of the end 99 of lever 96 with cam surface 201. During such feeding movement, the cam 155 is at the forward limit of its movement, in which position the lug 204 is also in the forward position, that is at the right end of the horizontal slot portion 203 of cam opening 190. In such position the cam 155 is more nearly vertical than when the needle is down (at which time the cam is inclined toward the rear), and the lug 204 therefore holds the feed dog up tightly against the material. During the descent of the needle, however, the lug 204 moves to the farther end of the slot portion 203, that is, toward the rear of the machine (left end, as shown in FIG. 4), and to a lower position. This permits the feed dog to drop, the tongue 178 moving down in the opening 182. The dog is also urged downwardly by the engagement of the lever portion 99 with sloping surface 202, such engagement also retracting the feed dog toward the front of the machine. The lug 204 swings upwardly as it moves forwardly, urging the dog up against the bottom of the material, as noted.

Figure 28:
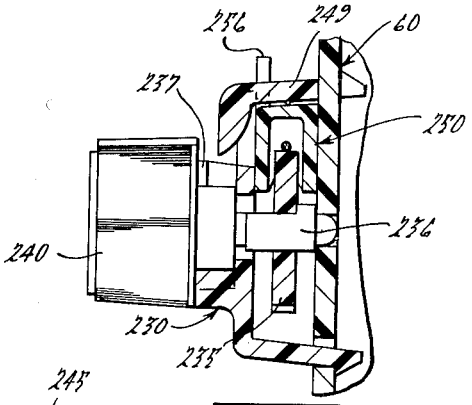
FIG. 28 is a vertical sectional elevational view taken substantially on the line XXVIII—XXVIII of FIG. 26 and looking in the direction of the arrows.
Figure 27:
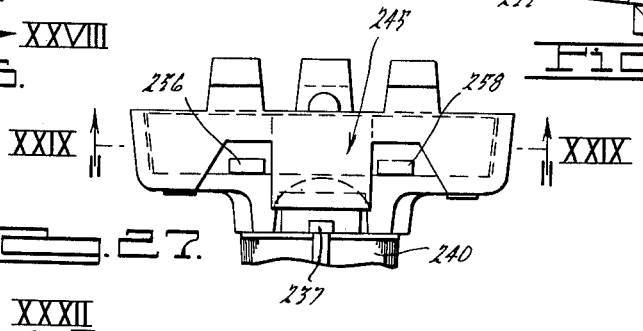
FIG. 27 is a top plan view of the same with the adjusting knob partly broken away.
Figure 31:
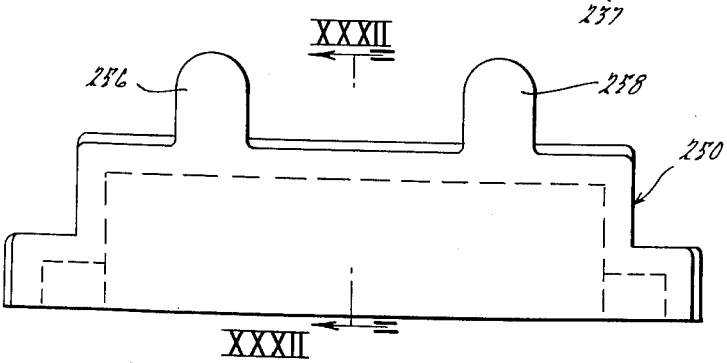
FIG. 31 is a greatly enlarged front elevational view of the friction block.
Figure 32:
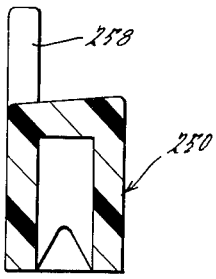
FIG. 32 is a vertical section taken substantially on the line XXXII—XXXII of FIG. 31 and looking in the direction of the arrows.

The thread, which will be contained on a conventional spool 226 on the spool post 225, is conducted to a thread-tensioning device secured to the front upper housing portion 61. The thread-tensioning device, which is generally designated 230, consists of a plastic housing 231 of generally shallow box form having its open face lying against the flat front of the upper casing portion 61 to define an enclosure 232 within which is a plastic cam member 235 having an external surface of modified spiral form and which is keyed on a plastic shaft 236 journaled in the tensioner housing 231 and in the front wall of housing member 60. The shaft and cam are rotatable by means of a knob 240 projecting from the front of the tensioner housing. A relatively large cutout opening 242 located partly in the front wall and partly in the top wall of the housing 231 extends transversely a substantial proportion of the transverse dimension of the housing 231. An integral thread guide finger 245 formed as a forwardly and downwardly hooked extension of the top wall of the housing 231 overlies the top and front portions of the opening 242 but does not extend all the way to the bottom thereof. The inner surface 246 of the depending front leg 247 of the guide finger 245 is of smoothly-finished partly spherical form. The more nearly horizontal top leg 249 of the guide finger is somewhat thicker than the remainder of the top wall of housing 231, and the bottom of leg part 249 is smooth, flat and at its side edges is rounded at the bottom, as indicated at 251. Vertically slidable within the housing 231 is a friction block generally designated 250 which in fore and aft cross section is of inverted U-form, as indicated in FIGS. 28 and 32. The friction block 250 has a smooth flat top surface which is urged against the bottom surface of the leg part 249 by the cam 235 acting through a wire spring 252 trapped in pockets defined by laterally projecting extension and guiding portions 254, 255 at the ends of the friction block 250. A pair of ears 256, 258 extend upwardly from the front wall of the friction block 250 through the opening 242 and project above the top wall 243 of the casing 231 at positions laterally spaced from the guide finger 245. The tension with which the block 250 is urged toward the top wall 243 is variable by rotating the cam 235 by means of the knob 240. The knob 240 is secured to the shaft as by cement and the cam and shaft are of course trapped in the housing 231. The knob has a lug 237 engageable with a stop 238 on housing 231 to limit rotation of the cam to slightly less than 360°. This not only prevents separation and possible loss of the parts of the tensioner, but desirable limits are thereby established as to the tightness and looseness of the stitching action of the machine.

The thread is trained from the spool and hooked beneath the guide finger 245, then pulled up and passed through the eye 260 at the upper end of the needle bar 82. The tensioner housing 231 and friction block 250 are formed of a plastic having low friction characteristics, such as "Delrin". During the threading operation the thread moves rearwardly under the hook-like guide finger 245 to the rear of the cutout opening 246 and behind the fingers 256, 258 so that the thread is substantially centered on top of the tension block, between the tension block and the lower surface of the guide finger.

From the eye 260 the thread is run downwardly to the eye in the point of the needle 128, through which the thread is passed then trained under the presser foot in the conventional manner.

It will be recognized that the "Delrin"-type material from which the principal working parts are formed, although having great strength and wear resistance, as noted previously, is also highly flexible in thinner sections, and is resistant to fatigue failure under repeated flexing. This characteristic is utilized by making the shank portion of the sewing hook thin enough to flex slightly laterally as the bulged portion 164 of the nose of the hook passes across the needle, while the needle also flexes, to provide a part of the flexibility which is necessary at this point. This eliminates the need to provide all of the flexibility required at this point in a single one of the two components, as will be appreciated by those skilled in the art.

In the modified construction shown in FIGS. 33 and 34 many parts will be seen to be identical to those disclosed in connection with the first-described embodiment, and will require no redescription. Corresponding parts are designated by like reference numbers distinguished by the addition of the letter "A".

In the modified construction the top lever 80A is not slidable along the axis of its fulcrum pin 84A, being held against such sliding movement by the elongated pin-supporting bosses 101A, 102A which are integrally carried by the rear and front casing portions 59A, 60A, respectively. As shown in FIG. 33 the needlebar actuating lever 80A is relatively deep in a vertical direction, so that it is stiff enough to resist substantial deflection in a vertical plane under the forces applied thereto to actuate the needlebar. In the horizontal plane, however, the actuating arm 81 of the lever, which is preferably made of an acetal resin such as "Delrin", is thinned sufficiently to be readily flexible laterally, except at its actuating end 85A, while remaining stiff in the vertical plane, as noted. Its rounded actuating end 85A is directly pivoted in a suitable opening in the crank arm 75A as in the case of the first embodiment.

As brought out in FIG. 34, the actuating arm 81 of the lever flexes transversely as the end 85A is orbited by actuation of the crank handle 70A to actuate the needlebar 82A vertically in a manner corresponding to the first embodiment.

This Detailed Description of Preferred Forms of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

What is claimed is:

1. In a toy sewing machine, a molded plastic frame structure including a substantially flat horizontal table portion, a column portion extending upwardly from the table portion near one end, a head portion projecting laterally from the column portion spacedly over the table portion and having a free end spaced from the column portion, a needlebar vertically reciprocably mounted in the head portion near the free end of the latter, a wall extending downwardly from the table portion and lying in a plane perpendicular to the direction of projection of the head portion and so spaced from the column portion as to be relatively close to and beside but spaced from the path of a needle carried by the needlebar, thread stitch-forming means carried by said wall for coaction with the needle and with a thread carried thereby, and actuating means for said stitch-forming means and for said needlebar, said actuating means being positioned and supported by said frame structure, said actuating means for reciprocating said needlebar comprising a lever of the first class, characterized by means carried by the head portion for positioning and supporting the lever including an elongated fulcrum pin portion on which the lever is axially slidable and angularly rockable, a crank also supported and positioned by the frame structure, said lever having the end of its actuating arm operatively interengaged with said crank and swingable in a circular orbit by rotation of the crank, and having the end of its load arm operatively interengaged with the needlebar for swinging movement relatively thereto about vertical and horizontal axes to actuate the needlebar vertically.

2. In combination with means as defined in claim 1, a second lever for transferring motion from the crank to the stitch-forming means, means carried by said frame structure for supporting and positioning said second lever, and means operatively interconnecting said levers.

3. Means as defined in claim 2 including a wall portion integral with said previously-mentioned wall and extending downwardly from the table portion and integrally joined throughout its length thereto and lying at right angles to said first-mentioned wall, said means for supporting and positioning said second lever being attached to said wall portion.

4. A machine as defined in claim 2 wherein said means interconnecting the levers comprises a link having one end pivotally interconnected with and orbitally actuatable by the crank and the other end pivotally connected to the second lever.

5. In a toy sewing machine, a molded plastic frame structure including a substantially flat horizontal table portion, a column portion extending upwardly from the table portion near one end, a head portion projecting laterally from the column portion spacedly over the table portion and having a free end spaced from the column portion, a needlebar vertically reciprocably mounted in the head portion near the free end of the latter, a wall extending downwardly from the table portion and lying in a plane perpendicular to the direction of projection of the head portion and so spaced from the column portion as to be relatively close to and beside but spaced from the path of a needle carried by the needlebar, thread stitch-forming means carried by said wall for coaction with the needle and with a thread carried thereby, and actuating means for said stitch-forming means and for said needlebar, said actuating means being positioned and supported by said frame structure, said column portion, head portion and wall being molded integrally with the table portion, characterized in that said stitch-forming means comprises a hook element, a cam element for actuating the hook element, said elements being arranged on opposite sides of said wall, and means extending through the wall joining said elements for unitary rocking movement and resiliently urging the same against opposite sides of the wall.

6. A machine as defined in claim 5 wherein the hook element has a hub portion which is urged against the wall, other portions of the hook element being outspaced from the wall by the hub, and a feed dog having a guiding portion slidably interengaged with the wall and positioned in the space between the wall and said outspaced portions of the hook element.

7. A machine as defined in claim 6 wherein the actuating means also includes a lever having a cam actuating nose portion extending through a cam slot in said cam to actuate the latter, said nose portion also extending through the wall and being engageable with the guiding portion of the feed dog to actuate the dog.

8. A machine as defined in claim 7 wherein said last named means comprises a rivet-like member having a smooth shank on which at least one of said elements is slidably fitted, said member having a cupped integral head at one end resiliently deformable in a direction parallel to the axis of the shank and stressed to react against one of said elements through the head and reacting against the other of said elements through the shank.

9. In a sewing machine having an axially reciprocable needlebar, means for actuating the needlebar comprising a lever of the first class, fulcrum means supporting the lever for angular rotation about and axial movement along the fulcrum axis, said lever having a load arm operatively interengaged with the needlebar, such interengagement restricting relative movement between the needlebar and the end of the load arm in the direction of reciprocation of the needlebar but permitting oscillation of the load arm around the axis of reciprocation, and means for imparting orbital rotation to the free end of the actuating arm.

10. A machine according to claim 9 in which said last-named means comprises a crank operatively interengaged with the free end of the actuating arm.

11. In a machine according to claim 8, a lug on the cam extending through and beyond the wall and into engagement with the actuating portion of the feed dog to coact with said nose portion of the lever in actuating the dog.

12. In a toy sewing machine, a molded plastic frame structure including a substantially flat horizontal table portion, a column portion extending upwardly from the table portion near one end, a head portion projecting laterally from the column portion spacedly over the table portion and having a free end spaced from the column portion, a needlebar vertically reciprocably mounted in the head portion near the free end of the latter, a wall extending downwardly from the table portion and lying in a plane perpendicular to the direction of projection of the head portion and so spaced from the column portion as to be relatively close to and beside but spaced from the path of a needle carried by the needlebar, thread stitch-forming means carried by said wall for coaction with the needle and with a thread carried thereby, and actuating means for said stitch-forming means and for said needlebar, said actuating means being positioned and supported by said frame structure, characterized in that said stitch-forming means comprises a hook, a cam for actuating the hook, said hook and cam being arranged on opposite sides of said wall, and means extending through the wall joining said hook and cam for unitary rocking movement and holding the same closely against opposite sides of the wall.

13. In a sewing machine of the chain stitch type having a table portion, a needlebar, means for vertically reciprocating the needlebar to move a needle carried thereby downwardly through and up from the table portion, a hook portion swingable under the table portion in a planar path beside and close to the path of the needle, means for feeding work over the table portion under the needle, a flat wall under the table portion parallel to said plane of movement of the hook portion, the hook portion being pivotally supported on the wall, characterized by a cam fast with respect to the hook portion to swing therewith but located on the opposite side of the wall, and means interconnected with said means for reciprocating the needlebar for actuating the cam and hook portion in timed relation to the needlebar.

14. A sewing machine as defined in claim 13, further characterized in that the hook portion is spaced from the wall, and said feeding means comprises a feed dog having a part supported for sliding movement on the wall and interposed between the wall and hook portion.

15. A sewing machine as defined in claim 14, further characterized in that said means for actuating the cam and hook portion comprises a lever having a nose portion extending through a cam slot in the cam to actuate the latter and also extending through and beyond a slot portion in the wall and into engagement with said part of the feed dog to actuate the feed dog.

16. A sewing machine as defined in claim 15, further characterized by a lug portion on the cam extending through additional slot portions in the wall and in said part of the feed dog and cooperating with said nose portion to control the actuation of the feed dog.

17. In a sewing machine having an axially reciprocable needlebar, means for actuating the needlebar comprising a crank, a fulcrum element having its axis perpendicular to the path of reciprocation of the needlebar, a lever of the first class rockable about the axis of the fulcrum element and having a load arm operatively engaged with the needlebar, said lever having an actuating arm including a portion at the end of said actuating arm remote from the fulcrum element movable in directions parallel to the axis of the fulcrum and directly engaged with and orbitally rotatable by the crank to reciprocate the load arm and needlbar.

18. A sewing machine as defined in claim 17 wherein the actuating arm of said lever is laterally flexible to permit said portion at the end of said arm to move in directions parallel to said axis.

19. Means as defined in claim 18 wherein said actuating arm is relatively thin and flexible in its dimension parallel to said axis and is of a relatively greater dimension and resistant to substantial deformation under the forces applied thereto to actuate the needlebar in directions perpendicular to said axis.

20. Means as defined in claim 19 wherein said lever is formed of a molded plastic.

* * * * *